US011808407B2

(12) United States Patent
Andre Dias et al.

(10) Patent No.: US 11,808,407 B2
(45) Date of Patent: Nov. 7, 2023

(54) PRESSURIZED GAS CONTAINER WITH AN ELECTRONIC DEVICE AUTOMATICALLY CALCULATING THE EXPIRY DATE OF THE GAS

(71) Applicant: L'Air Liquide, Société Anonyme pour l'Etude et l'Exploitation des Procédés Georges Claude, Paris (FR)

(72) Inventors: Sofia Andre Dias, Gentilly (FR); Federica Bellingeri, Zemst (BE)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 425 days.

(21) Appl. No.: 17/192,051

(22) Filed: Mar. 4, 2021

(65) Prior Publication Data

US 2021/0278047 A1 Sep. 9, 2021

(30) Foreign Application Priority Data

Mar. 4, 2020 (FR) ..... 2002172

(51) Int. Cl.
*F17C 13/00* (2006.01)
*F17C 13/02* (2006.01)
(Continued)

(52) U.S. Cl.
CPC ..... *F17C 13/025* (2013.01); *F17C 13/04* (2013.01); *G08B 5/38* (2013.01); *G08B 21/182* (2013.01);
(Continued)

(58) Field of Classification Search
CPC ..... F17C 13/025; F17C 13/04; F17C 2201/0104; F17C 2205/0323;
(Continued)

(56) References Cited

U.S. PATENT DOCUMENTS 4,354,383 A * 10/1982 Hartel ..... G01F 22/02 73/302
4,530,370 A * 7/1985 Horky ..... A01J 7/022 73/221

(Continued)

FOREIGN PATENT DOCUMENTS

| | | |
|---|---|---|
| DE | 10 2017 006013 | 12/2018 |
| EP | 2 918 892 | 9/2015 |
| EP | 2 918 893 | 9/2015 |

OTHER PUBLICATIONS

French Search Report for corresponding FR 2002172, dated Nov. 12, 2020.

*Primary Examiner* — Ojiako K Nwugo
(74) *Attorney, Agent, or Firm* — Elwood L. Haynes

(57) ABSTRACT

The invention relates to a pressurized gas container, in particular a gas cylinder, having an internal volume for gas storage, a fluid-distributing valve, a pressure sensor and microprocessor-based control means. The microprocessor-based control means are configured to detect filling of the gas container with gas, by comparing said at least one pressure value measured by the pressure sensor with at least one predefined and stored reference pressure threshold value; then to initiate a timer on the basis of a detection of filling of the gas container with gas; and to trigger a warning when the timer exceeds a given period calculated from the initiation of the timer.

14 Claims, 1 Drawing Sheet

(51) Int. Cl.
*F17C 13/04* (2006.01)
*G08B 5/38* (2006.01)
*G08B 21/18* (2006.01)

(52) U.S. Cl.
CPC ..... *F17C 2201/0104* (2013.01); *F17C 2205/0323* (2013.01); *F17C 2221/011* (2013.01); *F17C 2221/031* (2013.01); *F17C 2250/032* (2013.01); *F17C 2250/036* (2013.01); *F17C 2250/043* (2013.01); *F17C 2250/0443* (2013.01); *F17C 2270/025* (2013.01)

(58) Field of Classification Search
CPC ..... F17C 2221/011; F17C 2221/031; F17C 2250/032; F17C 2250/036; F17C 2250/043; F17C 2250/0443; F17C 2270/025; F17C 2201/032; F17C 2201/056; F17C 2201/058; F17C 2203/0639; F17C 2203/0646; F17C 2203/0663; F17C 2205/0165; F17C 2205/0188; F17C 2205/0308; F17C 2205/0338; F17C 2221/014; F17C 2221/017; F17C 2221/03; F17C 2223/0123; F17C 2223/036; F17C 2250/0473; F17C 2250/0491; F17C 2250/0495; F17C 2250/075; F17C 2260/026; F17C 2265/04; F17C 13/02; G08B 5/38; G08B 21/182
See application file for complete search history.

(56) References Cited

U.S. PATENT DOCUMENTS

| | | | | |
|---|---|---|---|---|
| 4,921,134 | A * | 5/1990 | Aschberger | B01F 35/20 222/64 |
| 9,133,004 | B2 * | 9/2015 | Clusserath | B67C 3/12 |
| 10,533,709 | B2 | 1/2020 | Jacobsen et al. | |
| 2010/0107765 | A1 * | 5/2010 | Murakami | G01N 29/043 73/587 |
| 2011/0112737 | A1 * | 5/2011 | Neelakantan | F16D 48/066 701/67 |
| 2015/0260343 | A1 | 9/2015 | Baune et al. | |
| 2015/0260344 | A1 | 9/2015 | Frenal et al. | |
| 2018/0071561 | A1 * | 3/2018 | Huelsen | A62C 99/0018 |

* cited by examiner

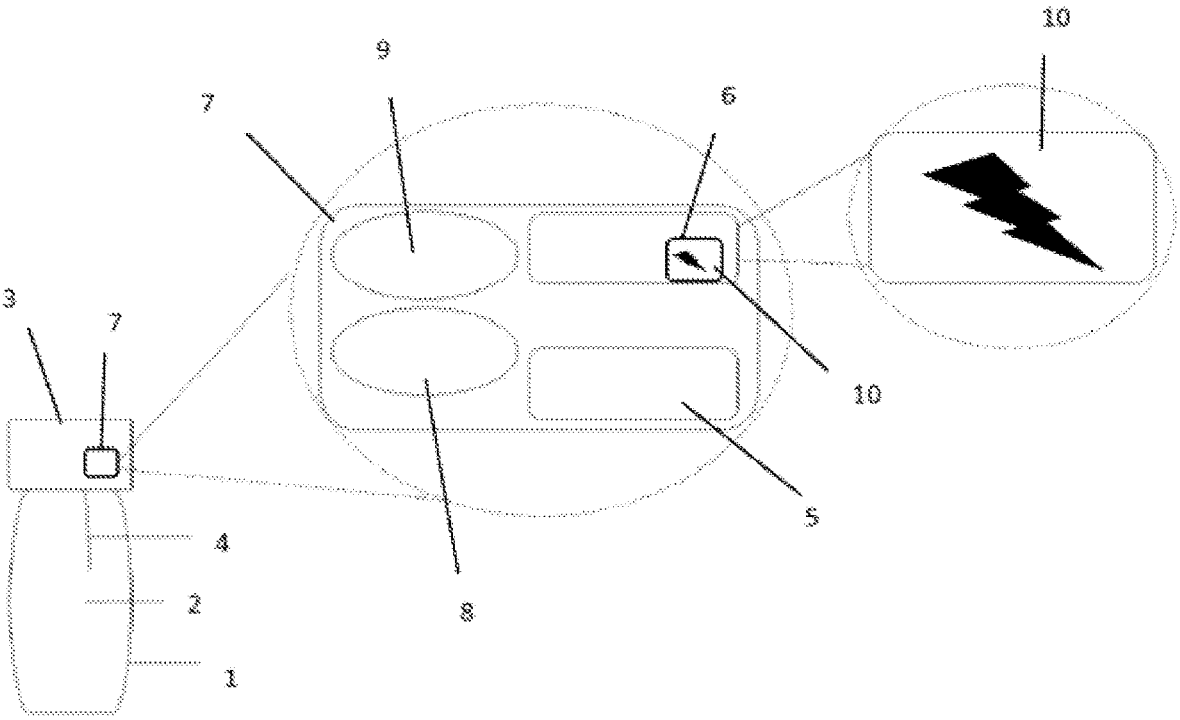
10
9
7
6
3
7
10
5
4
2
8
1

PRESSURIZED GAS CONTAINER WITH AN ELECTRONIC DEVICE AUTOMATICALLY CALCULATING THE EXPIRY DATE OF THE GAS

CROSS REFERENCE TO RELATED APPLICATIONS

This application claims the benefit of priority under 35 U.S.C. § 119 (a) and (b) to French Patent Application No. 2002172, filed Mar. 4, 2020, the entire contents of which are incorporated herein by reference.

BACKGROUND

The invention relates to a pressurized gas container, in particular a pressurized gas cylinder, equipped with a fluid-distributing valve comprising an electronic device with digital display configured to initiate a timer and to automatically calculate an expiry date of the gas contained in the container and to display, if appropriate, an expiry warning on the digital display, for example a dedicated warning icon.

Medical gases such as oxygen, the mixtures $NO/N_2$, $N_2O/O_2$, $He/O_2$, medical air, etc., are generally stored in pressurized gas containers, in particular gas cylinders.

These gas containers are commonly equipped with a distributing valve, with or without an integrated pressure-regulating system, serving to supply the medical gas, and with a dial-type or digital manometer serving to display the residual gas pressure. In general, the valve and the manometer are protected by a protective covering, also called a cap, which serves to protect them from impacts, falls, soiling, etc.

Thus, document EP-A-2918893 proposes such a gas cylinder equipped with a valve, having an integrated pressure regulator or IPR, and with a mechanical dial-type manometer, while document EP-A-2918892 proposes a gas cylinder equipped with an electronic device having a digital display screen.

However, like all medicaments, medical gases have an expiry date. The use of a gas beyond its expiry date must be avoided, since this could compromise the efficacy of the treatment of the patient with this gas.

Equipping each gas cylinder with a label bearing this expiry date is impractical and extremely time-consuming, especially since the label on each cylinder has to be changed each time the cylinder is filled with fresh gas, so as to renew the expiry date of the fresh gas introduced into the cylinder.

Moreover, a label of this kind can get mislaid, torn off or damaged and/or can cause errors by being misread by the user.

Finally, the user has to remember to check that the expiry date of the gas has not passed before each use, which is something he may forget to do and which thus poses a risk of using gas that has expired.

The problem is therefore to be able to rapidly, easily and automatically calculate an expiry date of a medical gas (i.e. gaseous medicament) stored in a gas container and, moreover, to warn the user when the expiry date is exceeded, so as to avoid gas being used after its expiry date, thereby also avoiding the disadvantages mentioned above.

SUMMARY

The solution of the invention lies in a pressurized gas container, in particular a gas cylinder, comprising an internal volume for storing gas under pressure, comprising:

a fluid-distributing valve, a pressure sensor for measuring the pressure of the gas and for supplying at least one measurement signal, microprocessor-based control means configured to process said at least one measurement signal supplied by the pressure sensor and to determine at least one measured pressure value, characterized in that the microprocessor-based control means are configured to:

a) detect filling of the gas container with gas, by comparing said at least one measured pressure value with at least one predefined and stored reference pressure threshold value, and b) initiate a timer on the basis of a detection of filling of the gas container with gas.

Depending on the embodiment in question, the container of the invention can comprise one or more of the following features:

the microprocessor-based control means are configured to trigger a warning when the timer exceeds a given period calculated from the initiation of the timer.

the microprocessor-based control means are arranged in an electronic device with a digital display, preferably in the housing of an electronic device.

the electronic device is a digital manometer for determining a gas pressure and/or a residual amount of gas.

the microprocessor-based control means are configured to determine that filling of the container has taken place when the measured pressure value is greater than or equal to the reference pressure threshold value.

the microprocessor-based control means are configured to detect the change from a first pressure below the pressure threshold value to a second pressure above the first pressure and greater than or equal to the reference pressure threshold value, whether during the first filling of the container (that is to say a container that has never been used) or during a refilling of the container (that is to say a container that has already been filled, emptied by use of the gas, and then filled again).

the reference pressure threshold value is at least 130 bar abs, for example of the order of 137 or 200 bar abs.

the timer is configured to measure the time in milliseconds.

the microprocessor-based control means are configured to convert the time (i.e. period) measured in milliseconds by the timer into months and/or years. Of course, another conversion is possible, for example into days, months and/or years.

the microprocessor-based control means are configured to record the date at which the timer is initiated, that is to say at which filling of the gas container is detected. This date is called the "filling date".

the microprocessor-based control means are configured to reset the timer before it is initiated (from step b), that is to say set it or return it to zero from the filling date.

the microprocessor-based control means are configured to reset the timer by additionally erasing an earlier filling date that has previously been recorded/stored, for example upon renewed filling of a container that has already been filled one or more times previously.

the data storage means are configured to store a filling date of the container and an expiry date of the gas, when filling of the gas container is detected.

the microprocessor-based control means are additionally configured to erase every filling date of the container and/or gas expiry date previously stored by the data storage means, when filling of the gas container is detected, that is to say the recording of a new filling date of the. container and/or of a new expiry date of the gas overwrites/erases any earlier recording of such filling dates and/or gas expiry dates.

the microprocessor-based control means are configured to additionally record/store a new filling date during the resetting of the timer.

the microprocessor-based control means are configured to calculate and record the date at which the timer will exceed the given period calculated from the initiation of said timer, that is to say from the filling date. This date is called the "gas expiry date".

the microprocessor-based control means are configured to calculate the expiry date of the gas by adding a predefined expiry period to the filling date.

the predefined expiry period is several years, for example 5 years.

the electronic device additionally comprises data storage means configured to store the reference pressure threshold value and the predefined expiry period.

the microprocessor is configured to record (new) dates, in particular the filling date and the expiry date that are calculated from said filling date.

the digital display of the electronic device is configured to display a warning icon in the event of a warning being triggered.

the microprocessor-based control means comprise one or more microprocessors.

the microprocessor-based control means are configured to additionally trigger an acoustic alarm in the event of a warning being triggered.

the data storage means comprise a read-only memory, preferably an EEPROM or similar.

the electronic device is fixed to the gas-distributing valve.

the electronic device comprises the microprocessor.

at least one electrical power source supplies electrical power to the digital display, the one or more microprocessors and/or the pressure sensor.

the pressure sensor is arranged so as to measure the pressure of the gas within the internal gas passage of the fluid-distributing valve.

the fluid-distributing valve is protected by a protective covering comprising a rigid covering body arranged around said fluid-distributing valve.

the housing of the electronic device comprising the digital display is accommodated in an opening made in the covering body.

the covering body defines an internal volume dimensioned to accommodate the gas-distributing valve.

the electrical power source comprises one or more electric batteries or cells, which may or may not be rechargeable.

the one or more microprocessors use one or more algorithms.

the microprocessor-based control means comprise an electronic board on which the one or more microprocessors are arranged.

the microprocessor-based control means comprise at least one microcontroller. More precisely, one or more microprocessors can be integrated in the electronic device in the form of a microcontroller.

the microprocessor-based control means, typically a microcontroller, are configured to record data, in particular within software or an algorithm.

the covering body is made of a polymer material, of metal or of combinations thereof.

the covering body comprises one or more carrying handles; preferably the carrying handle is arranged so as to surmount the covering, i.e. it is located substantially on top of the covering.

the gas-distributing valve is a valve with an integrated pressure regulator or IPR.

the fluid-distributing valve is made of copper alloy, such as brass.

the covering body further comprises a securing system designed to allow it to be secured to a support, in particular to a bar of a hospital bed or to a stretcher for carrying a patient or the like.

the covering body further comprises a movable, preferably pivoting, securing system.

the fluid container is a pressurized gas cylinder containing a gas under pressure, in particular a medical gas, such as oxygen.

the fluid container, when full, contains a gas at a pressure of at least 130 to 200 bar abs, or even at least 300 bar abs.

the fluid container has a cylindrical, in particular ogival, general shape, made of metal or metal alloy (e.g. steel, aluminium, etc.) or of composite material(s).

the fluid container contains a gas or a mixture of gases, such as oxygen, an $NO/N_2$, $O_2/N_2O$ or $He/O_2$ mixture, air, etc.

BRIEF DESCRIPTION OF THE DRAWING

The invention will now be better understood from the following detailed description, which is provided by way of a non-limiting illustration, with reference to the appended figure, in which:

FIG. 1 is a schematic representation of a fluid container with a digital display according to the invention.

DETAILED DESCRIPTION OF PREFERRED EMBODIMENTS

FIG. 1 shows a pressurized gas container 1 according to the invention, namely here a gas cylinder, comprising an internal volume 2 for storing gas under pressure, and additionally equipped with a fluid-distributing valve 3, such as an IPR, through which there is at least one internal passage for gas in fluidic communication with the internal volume 2 of the container 1, so as to convey the gas within the valve 3.

The fluid-distributing valve 3 comprises a pressure sensor 4 for measuring the pressure of the gas, within the internal passage for gas and/or in the internal volume 2 of the container 1, and for supplying at least one pressure measurement signal to microprocessor-based control means which are configured to process the one or more pressure measurement signals supplied by the pressure sensor 4. The microprocessor-based control means 5 comprise, for example, an electronic board supporting one or more microprocessors that use one or more algorithms or the like, preferably a microcontroller.

Also provided is a digital display 6 borne by a housing of an electronic device 7, for example a digital manometer, fixed to the fluid-distributing valve 3, which may be accommodated in an opening or compartment provided in the body of a protective covering (not shown) arranged around the fluid-distributing valve 3 and serving to protect it from impacts or other possible damage, for example a rigid covering made of polymer and/or of metal.

The housing of the electronic device 7 also comprises the microprocessor-based control means 5, typically the electronic board, using one or more algorithms.

Preferably, the fluid container 1 is a gas cylinder of axis AA comprising a cylindrical body defining the internal volume 2 for storing gas at high pressure, typically a maximum pressure of 130 to 300 bar abs, or even beyond 300 bar abs, and a neck comprising an orifice that is in communication with the internal volume 2 and allows the gas to be withdrawn from the internal volume 2 or, conversely, allows it to be filled when it is empty.

The fluid-distributing valve 3 is mounted, typically screwed, at the level of the orifice of the neck of the gas cylinder. It comprises a connector or end fitting for distributing gas, to which an item of medical equipment, a flexible tube or another device using or routing the gas delivered by the valve 3 can be connected. A member for adjusting the flow rate, namely here a rotary handwheel or the like, allows a user to adjust the desired value of the gas flow rate.

It is possible to provide one or more carrying handles connected to the body of the covering and dimensioned so as to be able to be gripped manually by a user in order to allow convenient handling and/or transport of the gas container/valve/covering assembly, and/or a movable, preferably pivoting, securing device or system that allows the gas cylinder/valve/covering assembly to be secured to a support, such as a bar of a hospital bed, to a stretcher, to a rail or the like.

The digital display 6 comprises a digital screen, for example a liquid-crystal display (LCD), etc., supported by the rigid housing of the electronic device 7 and supplied with electrical power by an electrical energy source (not visible) arranged in the covering, for example one or more batteries or cells placed in a cell compartment made in the wall of the covering body and closed by a removable flap or the like.

According to the invention, the microprocessor-based control means 5 are configured to process the one or more measurement signals supplied by the pressure sensor 4, which measures the pressure of the gas stored in the container 1, and to determine one or more pressure values measured on the basis of the one or more measurement signals.

They then make it possible to detect filling (including refilling) of the gas container 1 with fresh gas, for example when the cylinder is located at a filling centre after it has been used and emptied of the gas that it contained, by comparing the one or more measured pressure values with a predefined and stored reference pressure threshold value, typically a reference pressure threshold value of at least 130 bar abs, for example 137 bar abs or 200 bar abs. This predefined reference pressure threshold value can be stored in storage means 9 such as a computer memory of the EEPROM type.

When the microprocessor-based control means 5 detect a measured pressure value in the container 1 that is greater than the stored reference pressure threshold value, they interpret this detection as a filling of the gas container 1 with fresh gas, since, when the container 1 was empty or almost empty, the measured pressure values were all below this reference pressure threshold value.

The microprocessor-based control means 5 then initiate a timer 8 on the basis of this detection, particularly if they reset it to zero. Moreover, the microprocessor-based control means 5 store (in 9) this moment as being the "filling date" of the container 1, which allows them to additionally calculate a "gas expiry date" on the basis of the filling date, and they begin to count the time that passes from said filling date.

During the resetting of the timer 8, the microprocessor-based control means 5 optionally erase any other filling date and/or gas expiry date that have previously been recorded, for example during a previous filling of the gas container.

The microprocessor-based control means 5 calculate the gas expiry date by adding a predefined expiry period, typically of several years, for example 5 years, to the filling date. This expiry date is recorded (in 9) by the microprocessor-based control means 5. These means then permanently monitor the container 1 in order to detect whether the timer 8 exceeds the expiry date which reflects an expiry of the gas.

If it is detected that the given period calculated from the initiation of the timer has been exceeded, that is to say if it is detected that the expiry date has been exceeded, the control means 5 are configured to trigger a visual and/or acoustic warning, so as to alert the user to the date having been exceeded. Thus, a visual warning can be triggered in the form of a specific warning icon 10 being displayed on the display screen and can be accompanied by emission of the acoustic warning, or even by a flashing light, for example from the display screen 6 or one or more specific diodes.

Like all medicaments, medical gases have an expiry date. The use of these gases beyond the intended date could compromise the efficacy of the treatment of the patient.

By virtue of the present invention, it is possible to avoid a situation where a cylinder of medical gas is used after its expiry date.

Moreover, each time filling is detected, the previous filling date is overwritten, that is to say erased as mentioned above, and replaced by the new filling date. The same applies to the expiry date calculated on the basis of this new filling date. In this way, the expiry date of the gas is updated each time the container passes through the filling centre, that is to say calculated on the basis of each new filling date.

It will be noted that the digital display 6 of the device 7 can also display one or more other items of useful information, for example a value of the gas flow rate (in l/min in or in another unit), or else remaining gas (in hours and minutes).

More generally, the digital display 6 comprises a screen with a height of, for example, between 29 and 37 cm approximately, and with a width of, for example, between 39 and 43 cm approximately.

The digital display 6 can be arranged in the front panel, i.e. the front face, of the housing of the electronic device attached to the fluid-distributing valve 3 and accommodated in an opening of the body of the protective covering that protects the valve 3. The front panel can additionally comprise a button for acknowledging an alarm.

All of the components that require electrical power to operate (i.e. microprocessor, sensor, display, etc.) are supplied with power by an electrical energy source arranged for example in the covering, for example an electric cell or battery. In general, a fluid container 1, in particular a gas cylinder, equipped with a valve, such as an IPR, protected by a covering according to the invention, is suitable for storing and supplying gas under pressure, in particular a medical gas or mixture of gases, such as oxygen, an $NO/N_2$, $O_2/N_2O$ or $He/O_2$ mixture, air, etc.

What is claimed is:

1. A pressurized gas container, comprising an internal volume for storing gas under pressure, comprising: a fluid-distributing valve; a pressure sensor for measuring the pressure of the gas and for supplying at least one measurement signal; and a microprocessor-based control means configured to process said at least one measurement signal supplied by the pressure sensor and to determine at least one measured pressure value; wherein the microprocessor-based control means are configured to: detect filling of the gas container with gas, by comparing said at least one measured pressure value with at least one predefined and stored reference pressure threshold value, and initiate a timer on the basis of a detection of filling of the gas container with gas.

2. The pressurized gas container according to claim 1, wherein the microprocessor-based control means are additionally configured to trigger a warning when the timer exceeds a given period calculated from the initiation of the timer.

3. The pressurized gas container according to claim 1, wherein the microprocessor-based control means are arranged in an electronic device with a digital display.

4. The pressurized gas container according to claim 3, wherein the electronic device is fixed to the gas-distributing valve and is powered electrically by an electrical energy source.

5. The pressurized gas container according to claim 1, wherein the microprocessor-based control means are configured to determine that filling of the container has taken place when the measured pressure value is greater than or equal to the reference pressure threshold value.

6. The pressurized gas container according to claim 1, wherein the reference pressure threshold value is at least 130 bar abs.

7. The pressurized gas container according to claim 1, wherein the electronic device further comprises a data storage means configured to store the reference pressure threshold value and a predefined expiry period.

8. The pressurized gas container according to claim 7, wherein the predefined expiry period is several years.

9. The pressurized gas container according to claim 7, wherein the data storage means comprise a read-only memory.

10. The pressurized gas container according to claim 7, wherein the data storage means are configured to store a filling date of the container and an expiry date of the gas, when filling of the gas container detected.

11. The pressurized gas container according to claim 1, wherein the digital display of the electronic device is configured to display a warning icon in the event of a warning being triggered.

12. The pressurized gas container according to claim 1, wherein the microprocessor-based control means are configured to reset the timer before initiation.

13. The pressurized gas container according to claim 1, wherein the pressure sensor is arranged so as to measure the pressure of the gas within an internal gas passage of the gas-distributing valve in fluidic communication with the internal volume of the gas container.

14. The pressurized gas container according to claim 1, wherein the microprocessor-based control means are additionally configured to erase every filling date of the container and/or gas expiry date previously stored by the data storage means, when filling of the gas container is detected.

* * * * *